US008014690B2

(12) United States Patent
Sakata et al.

(10) Patent No.: US 8,014,690 B2
(45) Date of Patent: Sep. 6, 2011

(54) DEVELOPING UNIT AND IMAGE FORMING APPARATUS

(75) Inventors: Shoichi Sakata, Osaka (JP); Takahisa Nakaue, Osaka (JP); Toyotsune Inoue, Osaka (JP); Akihiro Watanabe, Osaka (JP); Masashi Fujishima, Osaka (JP); Yukihiro Mori, Osaka (JP)

(73) Assignee: Kyocera Mita Corporation (JP)

( * ) Notice: Subject to any disclaimer, the term of this patent is extended or adjusted under 35 U.S.C. 154(b) by 854 days.

(21) Appl. No.: 12/042,684

(22) Filed: Mar. 5, 2008

(65) Prior Publication Data

US 2008/0226320 A1 Sep. 18, 2008

(30) Foreign Application Priority Data

Mar. 14, 2007 (JP) ..... 2007-065552

(51) Int. Cl.
*G03G 15/06* (2006.01)

(52) U.S. Cl. ..... 399/55

(58) Field of Classification Search ..... 399/55
See application file for complete search history.

(56) References Cited

U.S. PATENT DOCUMENTS 5,890,042 A * 3/1999 Wong et al. ..... 399/285
2005/0191073 A1* 9/2005 Kawamura et al. ..... 399/55

FOREIGN PATENT DOCUMENTS

| | | |
|---|---|---|
| JP | 2-14704 | 3/1985 |
| JP | 2-14705 | 3/1985 |
| JP | 2-14706 | 7/1985 |
| JP | 2001-194876 | 7/2001 |

* cited by examiner

*Primary Examiner* — David Gray
*Assistant Examiner* — Andrew Do
(74) *Attorney, Agent, or Firm* — Gerald E. Hespos; Michael J. Porco

(57) ABSTRACT

A developing unit has a voltage-applicator (80) to apply a developing bias voltage to a developing roller (72). The voltage-applicator (80) applies the developing bias voltage for a first duration to apply an AC voltage having a rectangular waveform, and a second duration to stop applying the AC voltage. The AC voltage has a duty ratio of 50% or more in a direction for causing toner to develop an electrostatic latent image. The number of cycles of the AC voltage in the first duration is two or more, and the AC voltage has a voltage in a direction for pulling the toner back to the developing roller, just before transition to the second duration. The developing unit suppresses occurrence of image unevenness due to a fluctuation in developing gap. Thus, an image forming apparatus equipped with the developing unit forms a high-quality image while suppressing image unevenness.

4 Claims, 10 Drawing Sheets

| | | |
|---|---|---|
| CONTINUOUS WAVEFORM | | SOLID IMAGE |
| CONTINUOUS WAVEFORM | | HALFTONE DOT IMAGE |
| INTERMITTENT WAVEFORM | DUTY:40% | SOLID IMAGE |
| INTERMITTENT WAVEFORM | DUTY:40% | HALFTONE DOT IMAGE |
| INTERMITTENT WAVEFORM | DUTY:50% | SOLID IMAGE |
| INTERMITTENT WAVEFORM | DUTY:50% | HALFTONE DOT IMAGE |
| INTERMITTENT WAVEFORM | DUTY:60% | SOLID IMAGE |
| INTERMITTENT WAVEFORM | DUTY:60% | HALFTONE DOT IMAGE |

DEVELOPING UNIT AND IMAGE FORMING APPARATUS

BACKGROUND OF THE INVENTION

1. Field of the Invention

The present invention relates to a developing unit for use in an image forming apparatus utilizing an electrophotographic system, such a copier, a printer, a facsimile machine and a complex machine thereof, and an image forming apparatus equipped with the developing unit.

2. Description of the Related Art

A development unit for use in an image forming apparatus utilizing an electrophotographic system is designed to allow toner carried by a developing roller to fly toward a surface of a photoconductive drum which is an image support member having thereon an electrostatic latent image formed thereon in conformity to image data, so as to form a toner image. In the image forming apparatus equipped with such a developing unit, the toner image formed on the photoconductive drum is transferred onto a recording medium, such as a sheet. Then, the transferred toner image is heated and fixed on the recording medium by a fixing unit. In this manner, the image forming apparatus can form an image conforming to the image data, on the recording medium.

Among various types of the above image forming apparatuses, a tandem-type image forming apparatus is known as one having excellent high-speed performance, wherein a plurality of image forming units corresponding to respective colors of toner to be used are arranged in a line, in such a manner as to perform a color superimposition process on an intermediate transfer belt while forming each color image in synchronization with a feed rate of the intermediate transfer belt. Although the tandem-type image forming apparatus surely has excellent high-speed performance, it has a problem about an increase in size due to the need for the in-line arrangement of the plurality of image forming units for respective colors. As one of the measures against this problem, there has been proposed a small-sized tandem-type image forming apparatus designed to narrow a distance between adjacent ones of a plurality of photoconductive drums and correspondingly arrange a plurality of downsized image forming units. In the small-sized tandem-type image forming apparatus, a fluctuation in movement of a developing roller and a fluctuation in movement of a photoconductive drum become larger due to the downsizing. Generally, the downsizing also causes an increase in a fluctuation in movement of a pulley which is disposed on an outward side relative to a longitudinal end of the developing roller and adapted to be rotationally driven by the photoconductive drum while being kept in contact therewith, so as to define a gap (developing gap) between the photoconductive drum and the developing roller. Moreover, vibration or shaking of the developing roller becomes larger due to an increase in rotational speed thereof to accelerate the fluctuation in movement of the pulley. Consequently, in the small-sized tandem-type image forming apparatus, the developing gap is liable to be largely fluctuated.

The above developing unit includes one type designed such that a bias voltage is applied to a developing roller to cause toner to fly toward a photoconductive drum, based on a developing electric field formed between the developing roller and the photoconductive drum, i.e., by means of so-called "jumping phenomenon". In this type of developing unit, if a developing gap is fluctuated, the developing electric field will be changed to lead to a change in a toner amount on development, which causes image unevenness.

In view of meeting a recent demand for higher image quality, it is necessary to reduce a fluctuation in image density and image unevenness due to the fluctuation in the developing gap. Particularly, in the small-sized tandem-type image forming apparatus which has a relatively large fluctuation in the developing gap as described above, there is a strong need for reducing image unevenness due to the developing gap fluctuation.

In the above type of developing unit, image unevenness due to the developing gap fluctuation occurs in both a solid image and a low-gradation image (halftone dot image). The reason would be that an image density of an obtained image is influenced by the developing gap.

FIG. 11 is a graph showing an influence of a developing gap on respective image densities of a solid image and a halftone dot image, wherein the vertical axis represents a reflection image density of an obtained image, and the horizontal axis represents a developing gap (μm). This graph shows a result of a test where an image was formed using a developing bias voltage set as follows: a duty ratio of an AC voltage to be applied to a developing roller in a direction for causing toner to develop an electrostatic latent image=30%; a voltage (maximum voltage) in a direction for causing toner to develop an electrostatic latent image=1000 V; a voltage (minimum voltage) in a direction for pulling toner back to the developing roller=−500 V; and a frequency=2.5 kHz.

As seen in FIG. 11, respective image densities of the solid image and the halftone dot image are lowered in both cases where the developing gap is excessively narrow and excessively wide. Therefore, if the developing gap is fluctuated, the image density will be fluctuated to cause image unevenness. FIG. 11 also shows that the tendency of lowering in the image density is slightly different between the solid image and the halftone dot image.

As above, while both the solid image and the halftone dot image are influenced by the developing gap, a pattern of the influence is different therebetween. Thus, it has been proposed to generally increase a toner amount on development in order to reduce image unevenness due to the developing gap fluctuation. However, if the toner amount on development is increased up to a given value or more, toner scattering during a transfer process, or an adverse effect on a fixing performance is likely to occur.

As a development technique of controlling a transfer bias voltage in the jumping phenomenon, there has been known a technique of applying a blank pulse bias where a ratio of a first duration to form an alternate electric field between a developing roller and a photoconductive drum to a second duration to stop forming the alternate electric field is set in the range of 1:0.5 to 1:10 (see the following Patent Publications 1 and 2). In connection with the above technique of applying the blank pulse bias in the jumping phenomenon, it is also disclosed that a last-stage component of the alternate electric field in the first duration is formed as an electric field component in a direction for pulling toner back to the developing roller (see the following Patent Publication 3). There has also been known an image forming apparatus using a two-component developing system, designed to apply a developing bias including an oscillation period and a pause period, to a developing roller supporting a two-component developing agent containing a toner and a carrier, wherein the developing bias, wherein a first oscillating bias just before transition from the oscillation period to the pause period is set in a direction for causing the toner to fly toward an image support member, and a second oscillation bias just before the first oscillation bias is set in a direction for pulling the toner back to the developing roller (see the following Patent Publication 4).

[Patent Publication 1] JP 02-014704B
[Patent Publication 2] JP 02-014705B
[Patent Publication 3] JP 02-014706B
[Patent Publication 4] JP 2001-194876A In the conventional developing unit, respective image densities of a solid image and a halftone dot image are lowered in both cases where a developing gap is excessively narrow and excessively wide, as described above. This would be based on the following factors.

In cases where the developing gap is excessively narrow, even if toner is attached to an electrostatic latent image, an electric field formed by an AC voltage in a direction for pulling the toner back to a developing roller becomes excessively strong, and thereby the toner attached to the electrostatic latent image is pulled away from the electrostatic latent image to cause lowering of a toner amount on development.

In cases where the developing gap is excessively wide, an electric field formed by an AC voltage in a direction for causing toner to develop an electrostatic latent image becomes excessively weak, and thereby a toner amount reaching the electrostatic latent image is reduced to cause lowering of the toner amount on development.

The difference in the tendency of lowering in image density between the solid image and the halftone dot image would be based on the following factors.

In the halftone dot image, an electric field to be formed by a difference between respective potentials in a latent image region (i.e., a portion of a photoconductive drum on which an electrostatic latent image is formed) and a non-latent image region (i.e., the remaining portion of the photoconductive drum on which no electrostatic latent image is formed), so-called "cross-talk electric field" arising from the potential in the non-latent image region", is relatively strong. Thus, the latent image region has a relatively strong toner retaining force. In the solid image, while an edge region has a relatively strong toner retaining force as with the halftone dot image, an inward region other than the edge region has a lower toner retaining force than that in the edge region. Therefore, when the developing gap becomes narrower, the solid image has a tendency to allow toner to be easily pulled away by the AC voltage as compared with the halftone dot image.

Further, as the cross-talk electric field arising from the potential in the non-latent image region becomes weaker, a developing electric field between the developing roller and the photoconductive drum becomes stronger. Thus, the halftone dot image or the edge region of the solid image has a weaker development electric field, and the inward region of the solid image has a stronger development electric field. Therefore, when the developing gap becomes wider, the solid image has a tendency to have a larger amount of toner reaching to the photoconductive drum as compared with the halftone dot image.

The Patent Publication 1 includes a description about an advantage of being able to suppress density unevenness due to non-uniformity in a development magnetic field. The Patent Publication 2 includes a description about an advantage of being able to suppress a negative characteristic that a solid image has a lower density than that of a halftone dot image. The Patent Publication 3 includes a description to the effect that the last-stage component of the alternate electric field in the first duration can be formed as an electric field component in a direction for pulling toner back to the developing roller, so as to suppress a fog phenomenon.

A development methods disclosed in each of the Patent Publications 1 to 3 is intended to reduce the number of times of a reciprocating movement of magnetic toner between the developing roller and the photoconductive drum without reducing a frequency of the AC voltage, in order to suppress the occurrence of density unevenness, positive characteristic or fog phenomenon due to a non-uniform developing magnetic field. That is, the development method is not designed to apply a developing bias voltage in such a manner as to suppress the occurrence of image unevenness due to the developing gap fluctuation, and thereby unable to solve the problem about image unevenness due to the developing gap fluctuation.

The Patent Publication 4 includes a description about an advantage of being able to suppress an image defect due to an abnormal electrical discharge which is likely to occur under a condition allowing an image to be obtained with high evenness and sufficient density, in an image forming apparatus using a two-component developing system.

This image forming apparatus is not designed to control a developing bias voltage in such a manner as to eliminate image unevenness due to the developing gap fluctuation, and thereby unable to solve the problem about image unevenness due to the developing gap fluctuation, as in the Patent Publications 1 to 3. Moreover, the image forming apparatus is based on a two-component developing system, and therefore adapted to apply a developing bias voltage to a developing roller around which a large amount of carrier exists. Therefore, even if such a developing bias voltage is applied to a developing roller around which only a few amount of carrier exists, a high-quality image cannot be obtained.

SUMMARY OF THE INVENTION

In view of the above conventional problems, it is an object of the present invention to provide a developing unit capable of suppressing image unevenness due to a fluctuation in a developing gap, and an image forming apparatus equipped with the developing unit.

In order to achieve the above object, according to one aspect of the present invention, there is provided a developing unit which comprises: a developing roller disposed in opposed relation to an image support member which has an electrostatic latent image formed thereon, and adapted to transport toner while supporting the toner on a surface thereof, and voltage-applying means adapted to apply a developing bias voltage to the developing roller, in such a manner as to cause the toner transported by the developing roller to fly onto a surface of the image support member so as to allow an electrostatic latent image pre-formed on the surface of the image support member to come out as a toner image. In the developing unit, the developing bias voltage to be applied from the voltage-applying means to the developing roller is set to satisfy the following conditions. The developing bias voltage including a first duration to apply an AC voltage having a rectangular waveform, and a second duration to stop applying the AC voltage, and the AC voltage has a duty ratio of 50% or more, in a direction for causing the toner to develop the electrostatic latent image. Further, the number of cycles of the AC voltage in the first duration is two or more, and the AC voltage has a voltage in a direction for pulling the toner back to the developing roller, just before transition from the first duration to the second duration.

In the developing unit of the present invention, the duty ratio of the AC voltage having a rectangular waveform is set at 50% or more, in the direction for causing the toner to develop the electrostatic latent image. That is, in the first duration to apply the AC voltage, a time-period to apply a voltage in the direction for developing an electrostatic latent image pre-formed on the surface of the image support member is equal to or greater than a time-period to apply a voltage in the direction for pulling the toner back to the developing roller. Thus, even when a developing gap becomes wider, a large amount of toner can reach the image support member so as to suppress image unevenness, particularly image unevenness due to lowering in density of a halftone dot image, which is likely to occur when the developing gap becomes wider.

Further, the number of cycles of the AC voltage in the first duration is set at two or more. That is, the voltage in the direction for causing toner to develop an electrostatic latent image, and the voltage in the direction for pulling toner back to the developing roller, are alternately applied two times or more each. Thus, a force to allow a toner attached to a latent image region to be more firmly attached thereto, and a force in the direction for pulling the toner away from the latent image region, are alternately applied to the toner to promote rearrangement of the toner so as to evenly attach the toner to the latent image region. In addition, the two types of alternate forces allow a toner attached to a non-latent image region to be attached to the latent image region. This makes it possible to form an image more accurately conforming to a shape of the electrostatic latent image.

Furthermore, the AC voltage has a voltage for pulling toner back to the developing roller, just before transition from the first duration to the second duration. That is, the force to pull toner back to the developing roller is lastly applied, and then the developing bias voltage is changed to the second duration to stop applying the AC voltage. Thus, a weak force for preventing the toner attached to the latent image region from being pulled away from the latent image region can be applied in the direction for causing toner to move from the image support member toward the developing roller for a relatively long time, so that a toner attached to the non-latent image region can be pulled away therefrom without pulling a toner attached to the latent region away therefrom so as to suppress a fog phenomenon. This makes it possible to suppress image unevenness, particularly image unevenness due to pulling-away in the solid image, which is likely to occur when the developing gap becomes narrower.

As above, the developing unit of the present invention can suppress the occurrence of image unevenness due to a fluctuation in the developing gap.

These and other objects, features and advantages of the present invention will become apparent upon reading the following detailed description along with the accompanying drawings.

DETAILED DESCRIPTION OF THE PREFERRED EMBODIMENTS

A developing unit according to a preferred embodiment of the present invention and an image forming apparatus equipped with the developing unit will now be specifically described based on the drawings.

Figure 1:
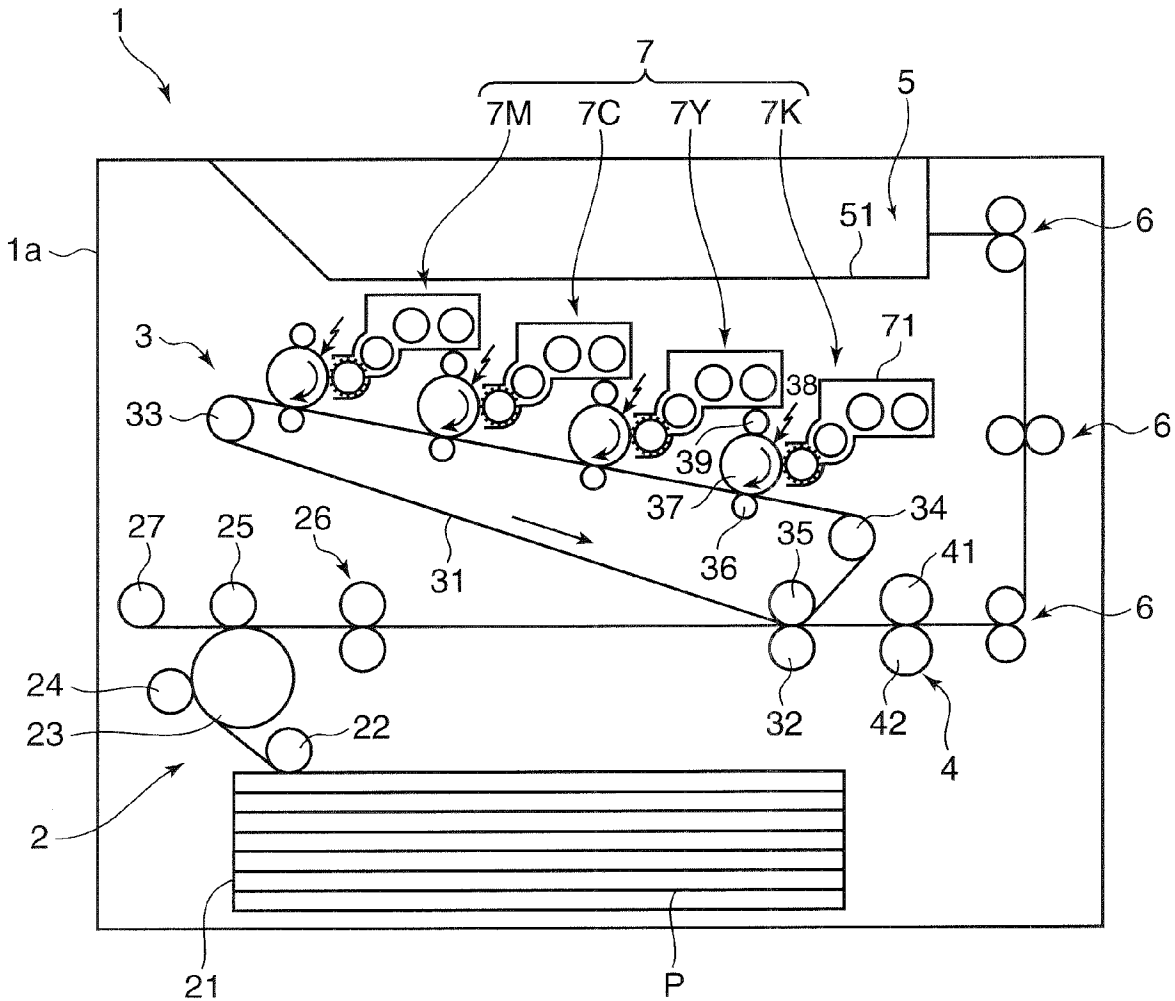
FIG. 1 is a schematic sectional view showing an overall structure of a color printer 1 equipped with a developing unit 71 according to an embodiment of the present invention.

A color printer as one example of the image forming apparatus employing the developing unit according to the embodiment of the present invention will be firstly described based on FIG. 1. FIG. 1 is a schematic sectional view showing an overall structure of the color printer 1 equipped with the developing unit 71 according to the embodiment of the present invention. As shown in FIG. 1, this color printer 1 has a box-shaped apparatus body 1*a*. The apparatus body 1*a* is internally provided with a sheet feed section 2 adapted to feed a sheet P, an image forming section 3 adapted to transfer a toner image conforming to image data or the like, onto the sheet P fed from the sheet feed section 2, while transporting the sheet P, and a fixing section 4 adapted to subject the sheet P having an unfixed toner image transferred thereon in the image forming section 3, to a fixing treatment for fixing the unfixed toner image onto the sheet P. The apparatus body 1*a* has a top surface formed as a sheet tray section 5 which is adapted to receive the sheet P ejected thereto after being subjected to the fixing treatment in the fixing section 4.

The sheet feed section 2 comprises a sheet feed cassette 21, a pickup roller 22, three sheet feed rollers 23, 24, 25 and a registration roller 26. The sheet feed cassette 21 is provided in an insertable and drawable manner relative to the apparatus body 1*a*, and adapted to store various sizes of sheets P. The pickup roller 22 is disposed at an upper left (in FIG. 1) position of the sheet feed cassette 21, and adapted to pick up the sheets P stored in the sheet feed cassette 21 one by one. Each of the sheet feed rollers 23, 24, 25 is adapted to send the sheet P picked up by the pickup roller 22, to a sheet transport path. The registration roller 26 is adapted to temporarily hold the sheet P sent to the sheet transport path by the sheet feed rollers 23, 24, 25, and then supply the sheet P to the image forming section 3 at a given timing.

The sheet feed section 2 further includes a manual sheet feed tray (not shown) attached to a left (in FIG. 1) lateral surface of the apparatus body 1*a*, and a pickup roller 27. The pickup roller 27 is adapted to pick up a sheet P placed on the manual sheet feed tray. The sheet P picked up by the pickup roller 27 is sent to the sheet feed path, and supplied to the image forming section 3 at a given timing by the registration roller 26.

The image forming section 3 comprises an image forming unit 7, an intermediate transfer belt 11 having an outer surface (contact surface) onto which a toner image conforming to image data electrically transmitted from a computer or the like is primarily transferred by the image forming unit 7, and a secondary transfer roller 32 adapted to secondarily transfer the toner image on the intermediate transfer belt 11, onto the sheet P sent from the sheet feed cassette 21.

The image forming unit 7 includes a black unit 7K, a yellow unit 7Y, a cyan unit 7C and a magenta unit 7M, which are disposed from an upstream side (right side in FIG. 1) to an downstream side, in this order. Each of the units 7K, 7Y, 7C, 7M has a photoconductive drum 37 disposed at a central position thereof rotatably in the arrowed direction (clockwise direction) to serve as an image support member. A charger unit 39, an exposure unit 38, a developing unit 71, a cleaning unit (not shown) and an eraser unit (not shown) are disposed around the photoconductive drum 37 from an upstream side of a rotation direction of the photoconductive drum 37, in this order.

The charger unit 39 is adapted to electrostatically charge an outer peripheral surface of the photoconductive drum 37 which is being rotated in the arrowed direction, in a uniform manner. For example, the charger unit 39 includes a corotron or scorotron-type charger based on a non-contact type discharge system, and a contact-type charge roller or charge brush. The exposure unit 38 comprises a so-called "laser scanning unit" adapted to emit a laser beam conforming to image data input from an image reader unit, onto the outer peripheral surface of the photoconductive drum 37 uniformly charged by the charger unit 38, so as to form an electrostatic latent image conforming to the image data, on the photoconductive drum 37. The developing unit 71 is adapted to supply toner onto the outer peripheral surface of the photoconductive drum 37 having the electrostatic latent image formed thereon, so as to form a toner image conforming to the image data. Then, the toner image is primarily transferred onto the intermediate transfer roller 31. The cleaning unit is adapted to clean toner which remains on the outer peripheral surface of the photoconductive drum 37 after completion of the primary transfer of the toner image onto the intermediate transfer belt 3 1. The eraser unit is adapted to eliminate electric charges on the outer peripheral surface of the photoconductive drum 37 after the completion of the primary transfer. The outer peripheral surface of the photoconductive drum 37 after being cleaned by the cleaning unit and the eraser unit is rotated toward the charger unit to perform a new primary transfer process.

The intermediate transfer belt 31 comprises an endless belt-shaped rotatable member wound around a plurality of rollers including a drive roller 33, a driven roller 34, a backup roller 35 and a primary transfer roller 36, in such a manner that the outer surface (contact surface) thereof is kept in contact with the outer peripheral surfaces of the respective photoconductive drums 37 of the units 7K, 7Y, 7C, 7M. The intermediate transfer belt 31 is adapted to be endlessly rotated by the plurality of rollers while being pressed against the photoconductive drum 37 by the primary transfer roller 36 which is disposed in opposed relation to a corresponding one of the photoconductive drums 37. The drive roller 33 is adapted to drivingly rotate based on a drive source, such as a stepping motor, so as to have a driving force for endlessly rotating the intermediate transfer belt 31. Each of the driven roller 34, the backup roller 35 and the primary transfer roller 36 is provided in a freely rotatable manner, and adapted to be drivenly rotated in conjunction with the endless rotation of the intermediate transfer belt 31 according to the drive roller 33. Each of the rollers 34, 35, 36 supports the intermediate transfer belt 31 while being drivenly rotated through the intermediate transfer belt 31 according to the driving rotation of the drive roller 33.

The primary transfer roller 36 is adapted to apply a primary transfer bias (having a polarity opposite to a charge polarity of toner) to the intermediate transfer belt 31. Thus, the toner images formed on the respective photoconductive drum 37 are sequentially transferred (primarily transferred) onto the intermediate transfer belt 31 circulatingly rotated in the arrowed direction (counterclockwise direction), in a superimposed manner.

The secondary transfer roller 32 is adapted to apply a secondary transfer bias having a polarity opposite to that of the toner image, to the sheet P. Thus, the toner image primarily transferred onto the intermediate transfer belt 31 is transferred onto the sheet P between the secondary transfer roller 32 and the backup roller 35. In this manner, a color transfer image (unfixed toner image) is transferred onto the sheet P.

The fixing section 4 is adapted to subject the transfer image transferred onto the sheet P in the image forming section 3, to the fixing treatment, and provided with a heating roller 41 adapted to be heated by an electric heating element, and a pressing roller 42 disposed in opposed relation to the heating roller 41, in such a manner that an outer peripheral surface of the pressing roller 42 is brought into press contact with an outer peripheral surface of the heating roller 41.

The transfer image transferred onto the sheet P by the secondary transfer roller 12 in the image forming section 3 is fixed onto the sheet P through the fixing treatment based on heat to be given to the sheet P when it passes through between the heating roller 41 and the pressing roller 42. Then, the sheet P after being subjected to the fixing treatment is ejected to the sheet tray section 5. The color printer 1 in this embodiment includes a transport roller 6 disposed at an appropriate position between the fixing section 4 and the sheet tray section 5.

The sheet tray section 5 is formed by concaving a top portion of the apparatus body 1 a so as to define a concaved top surface serving as a sheet tray 51 capable of receiving a sheet P ejected to a bottom of the top surface.

Figure 2:
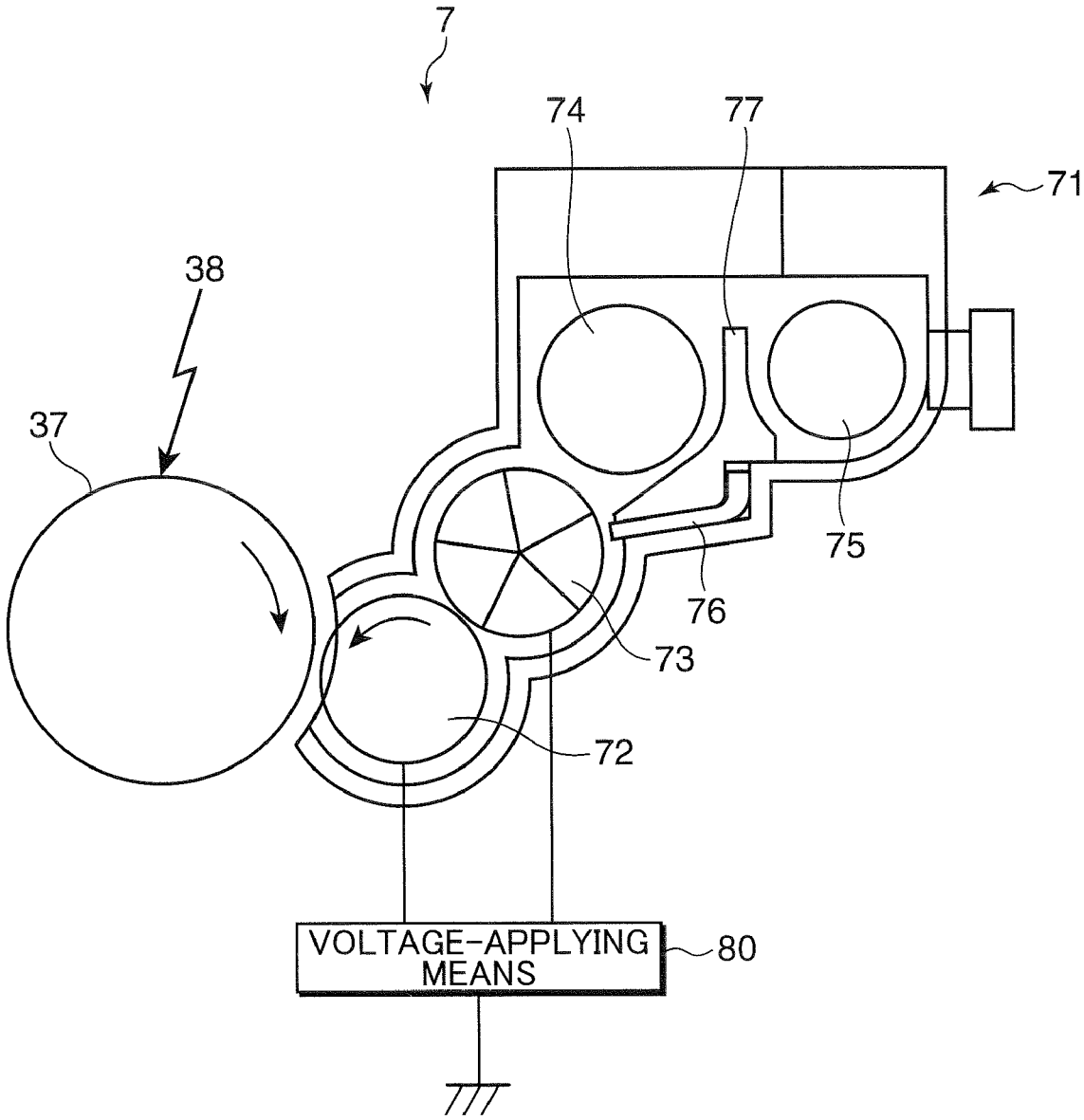
FIG. 2 is a schematic sectional view showing the structure of the developing unit 71 according to the embodiment of the present invention.

The structure of the developing unit 71 according to the embodiment of the present invention will be described below. FIG. 2 is a schematic sectional view showing the structure of the developing unit 71 according to the embodiment of the present invention, wherein the developing unit 71 incorporated in the color printer 1 illustrated in FIG. 1 and a vicinity thereof are enlargedly illustrated.

The developing unit 71 comprises a developing roller 72, a magnetic roller 73, a paddle mixer 74, an agitation mixer 75, a toner-chain cutting blade 76, a partition plate 77 and voltage-applying means 80.

The developing roller 72 is adapted to transport toner while supporting the toner on an outer peripheral surface thereof so as to allow an electrostatic latent image pre-formed on the outer peripheral surface of the photoconductive drum 37 to come out (be developed) as a toner image. The magnetic roller 73 is adapted to magnetically capture a two-component developing agent using a magnet disposed therewithin so as to create a magnetic brush and supply toner onto the developing roller 72. For example, a roller having a diameter of 20 mm may be used as the developing roller 72, and a roller having a diameter of 25 mm may be used as the magnetic roller 73.

Each of the paddle mixer 74 and the agitation mixer 75 has a spiral fin, and adapted to agitate the two-component developing agent while transporting the two-component developing agent in an opposite direction, so as to electrostatically charge toner. The paddle mixer 74 is also adapted to supply the two-component developing agent containing the charged toner and a carrier, onto the magnetic roller 73. The toner-chain cutting blade 76 is adapted to control a thickness of the magnetic brush formed on the magnetic roller 73. The partition plate 77 is disposed between the paddle mixer 74 and the agitation mixer 75 in such a manner to allow the two-component developing agent to freely pass therethrough on an outward side relative to both ends thereof. The voltage-applying means 80 comprises a power supply adapted to apply an after-mentioned voltage to each of the developing roller 72 and the magnetic roller 73.

Figure 3:
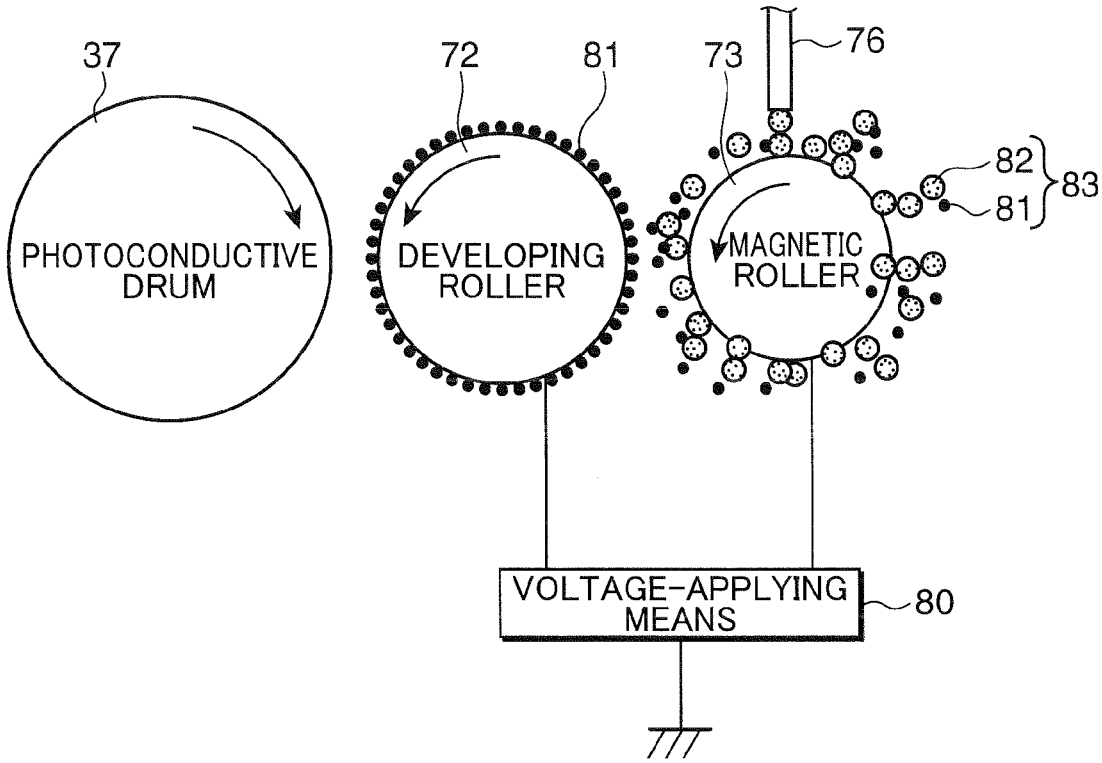
FIG. 3 is a schematic diagram for explaining a development operation of the developing unit 71.

FIG. 3 is a schematic diagram for explaining a development operation of the developing unit 71, wherein a positional relationship between respective ones of the developing roller 72, the magnetic roller 73 and the toner-chain cutter blade 76 is different from that in FIG. 2. A two-component developing agent 83 containing a carrier 82 and a toner 81 charged by the paddle mixer 74 and the agitation mixer 75 is supplied onto the magnetic roller 73. The two-component developing agent 83 supplied onto the magnetic roller 73 is formed as a magnetic brush by a magnet disposed within the magnetic roller 73, and transported in the form of the magnetic brush. Then, the magnetic brush is moved in conjunction with a rotation of a sleeve defining an outer peripheral of the magnetic roller 73, and, when the magnetic brush passes through between the toner-chain cutter blade 76 and the magnetic roller 73, a thickness of thereof is controlled or restricted. According to a voltage applied from the voltage-applying means 80, a potential difference is generated between the developing roller 72 and the magnetic roller 73. Thus, when the magnetic brush having a controlled thickness is moved to a position adjacent to the developing roller 72, only the charged toner 81 is moved onto the developing roller 72 according to the potential difference. The toner 82 moved onto the developing roller 72 is formed as an even toner layer. The voltage-applying means 80 further generates a potential difference between the photoconductive drum 37 and the developing roller 72. According to this potential difference, an image development is performed based on the electrostatic image formed on the photoconductive drum 37.

A developing bias voltage to be applied from the voltage-applying means 80 to the developing roller 72 will be described below.

Figure 4:
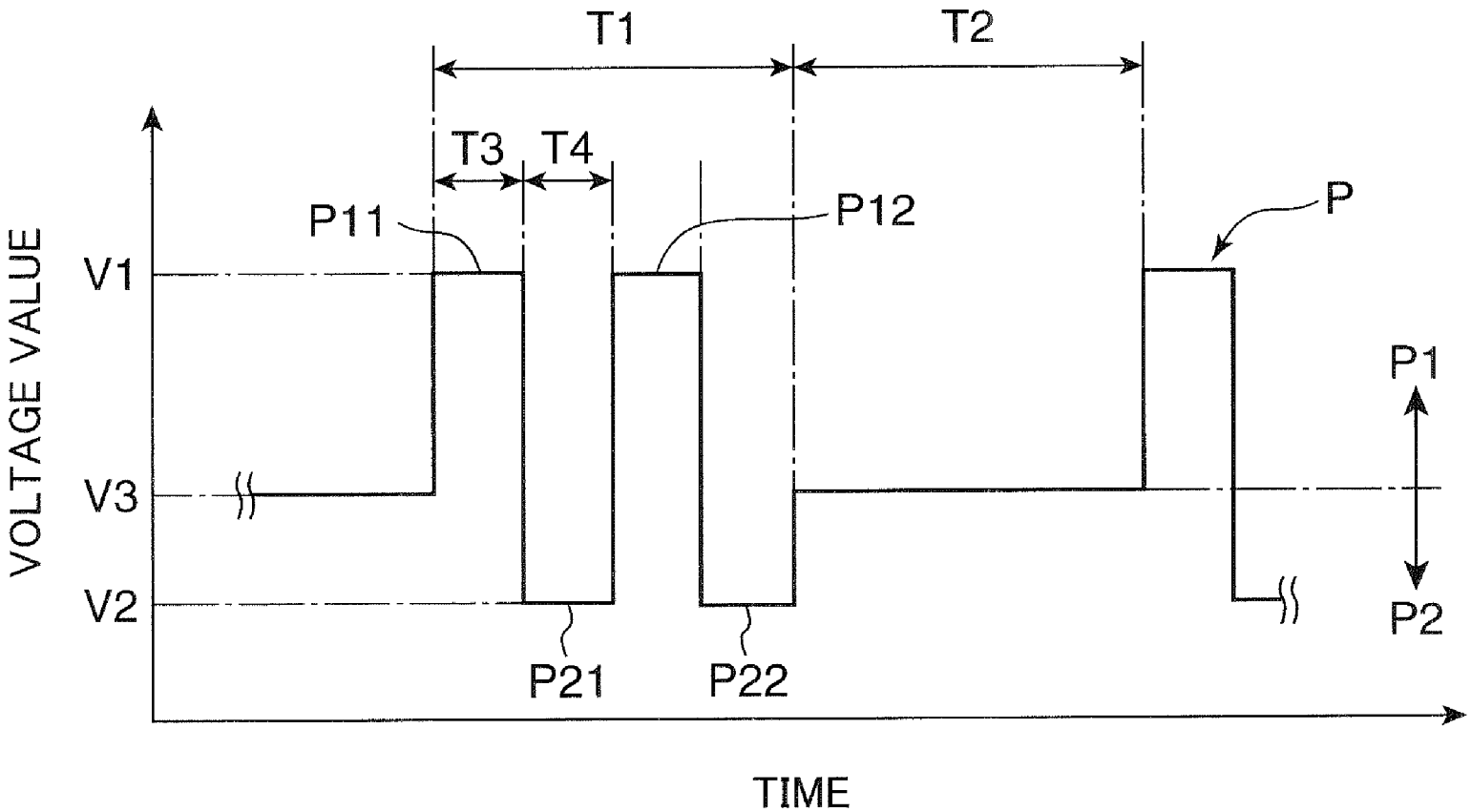
FIG. 4 is a diagram showing one example of a waveform P of a developing bias voltage.

FIG. 4 is a diagram showing one example of a waveform P of the developing bias voltage. As shown in FIG. 4, the waveform P of the developing bias voltage includes a first duration T1 to apply an AC voltage having a rectangular waveform, to the developing roller 72, and a second duration T2 to stop applying the AC voltage. The waveform P of the developing bias is set such that the AC voltage has a duty ratio of 50% or more, e.g., 50%, as shown in FIG. 4, in a direction for causing toner to develop an electrostatic latent image. Specifically, in the first duration T1 to apply an AC voltage, a time-period T3 to apply a voltage P11 (or P12) in a first direction P1 for developing an electrostatic latent image pre-formed on the outer peripheral surface of the photoconductive drum 37 is equal to a time-period T4 to apply a voltage P21 (or P22) in a second direction P2 for pulling toner back to the developing roller 72. In the developing bias voltage set such that T3 is equal to or greater than T4, even when a developing gap becomes wider, a large amount of toner can reach the photoconductive drum 37 so as to suppress image unevenness, particularly image unevenness due to lowering in density of a halftone dot image, which is likely to occur when the developing gap becomes wider.

Further, the waveform P of the developing bias voltage is set such that the number of cycles of the AC voltage in the first duration T1 is two or more, e.g., two, as shown in FIG. 4. In this developing bias voltage, the voltage P11 (or P12) in the first direction P1 for causing toner to develop an electrostatic latent image, and the voltage P21 (or P22) in the second direction P2 for pulling toner back to the developing roller 72, are alternately applied two times or more each. Thus, a force to allow a toner attached to a latent image region to be more firmly attached thereto, and a force in the direction for pulling the toner away from the latent image region, are alternately applied to the toner to promote rearrangement of the toner so as to evenly attach the toner to the latent image region. In addition, the two types of alternate forces allow a toner attached to a non-latent image region to be attached to the latent image region. This makes it possible to form an image more accurately conforming to a shape of the electrostatic latent image.

Furthermore, the waveform P of the developing bias voltage is set such that an AC voltage P22 just before transition from the first duration T1 to the second duration T2 is a voltage P2 in the second direction P2 for pulling toner back to the developing roller 72. In this developing bias voltage, the force to pull toner back to the developing roller 72 is lastly applied, and then the developing bias voltage is changed to the second duration T2 to stop applying the AC voltage. Thus, a weak force for preventing the toner attached to the latent image region from being pulled away from the latent image region can be applied in the direction for causing toner to move from the photoconductive drum 37 toward the developing roller 72 for a relatively long time, so that the toner attached to the non-latent image region can be pulled away therefrom without pulling the toner attached to the latent region away therefrom so as to suppress a fog phenomenon. This makes it possible to suppress image unevenness, particularly image unevenness due to pulling-away in the solid image, which is likely to occur when the developing gap becomes narrower.

As above, the developing unit 71 can apply the above developing bias voltage so as to suppress the occurrence of image unevenness due to the developing gap fluctuation.

Preferably, a voltage value VI of the voltage P11 (or P12) in the first direction P1 for causing toner to develop an electrostatic latent image is higher (greater) than an absolute value of a voltage value V2 of the voltage P21 (or P22) in the second direction P2 for pulling toner back to the developing roller 72.

As long as the above conditions are satisfied, the development bias voltage may consist only of an AC voltage, or may comprise a superimposed voltage formed by superimposing an AC voltage on a DC voltage. In the superimposed voltage, a DC voltage to be superimposed on an AC voltage preferably has a voltage value, e.g., 150 V or less, which is lower (less) than an absolute value of a voltage value V2 of a voltage P21 (or P22) in a second direction P2 for pulling toner back to the developing roller 72, in the AC voltage. A peak-to-peak value of the AC voltage is preferably set in the range of 500 to 2000 V, and may be set, for example, at 1200 V or 1500 V. The AC voltage preferably has a frequency of 1 to 6 kHz.

In a specific preferred example, as shown in FIG. 4, the developing bias voltage may be set as follows: respective time periods of the first and second durations =the same value; DUTY ratio (T3/T4)=50%; maximum voltage V1=1000 V; minimum voltage V2=−200 V; voltage V3 in the second duration=zero V; and the number of cycles=2.

Preferably, the voltage-applying means 80 is controlled to apply the AC voltage just before development. This makes it possible to suppress image unevenness due to the developing gap fluctuation.

While a thickness of a toner layer to be formed on the developing roller 72 varies depending on a resistance of toner and a ratio between respective circumferential velocities of the developing roller 72 and the magnetic roller 73, the voltage-application means 80 may be configured to change a potential difference between the developing roller 72 and the magnetic roller 73 so as to control the thickness of the toner layer. Specifically, when the potential difference between the developing roller 72 and the magnetic roller 73 is increased, an amount of toner to be moved from the magnetic roller 73 to the developing roller 72 will be increased to allow the toner layer to be formed on the developing roller 72 with a larger thickness. If the potential difference is reduced, the thickness of the toner layer on the developing roller 72 will be reduced. The potential difference between the developing roller 72 and the magnetic roller 73 can be set according to a voltage to be applied to the magnetic roller 73 by the voltage-application means 80. Preferably, this potential difference is set in the range of 100 to 350 V. Specifically, the voltage-applying means 80 may be configured to apply a DC voltage to the magnetic roller 73 so as to set the potential difference at a given value, e.g., 300 V. A peak-to-peak value of the AC voltage to be applied to the magnetic roller 73 is preferably set in the range of 1000 to 2500 V, and may be specifically set, for example, at 1800 V. A frequency of the AC voltage is preferably set in the range of 1 to 6 kHz, and may be specifically set, for example, at 4 kHz or 5 kHz. Further, a DUTY ratio of the AC voltage is preferably set at a DUTY ratio of 50% or more, and may be specifically set, for example at 70%.

In view of maintaining an even image density, in a period other than a timing of development, the voltage-applying means 80 may be effectively controlled to set respective potentials of the developing roller 72 and the magnetic roller 73 at the same values, i.e., eliminate the potential difference therebetween, so as to collect toner on the developing roller 72 to the magnetic roller 73 without imposing a load on the toner.

Preferably, the voltage-applying means 80 is operable to fix a voltage value of the AC voltage which is in the first direction P1 for causing toner to develop an electrostatic latent image, and change a voltage value of the AC voltage which is in the second direction P2 for pulling toner back to the developing roller 72. In this case, the AC voltage can be adjusted to generate a force to pull a toner attached to the non-latent image region away therefrom without pulling a toner attached to the latent image region away therefrom. This makes it possible to desirably adjust a toner density in an easy manner while suppressing the occurrence of image unevenness due to the developing gap fluctuation.

The color printer 1 may be further provided, but not shown, with toner patch forming means, density detection means and voltage-value determination means. The toner patch forming means is adapted to fix a voltage value of the AC voltage which is in the first direction P1 for causing toner to fly toward the photoconductive drum 37 in the first duration T1, and change a voltage value of the AC voltage which is in the second direction P2 for pulling the toner back to the developing roller in the first duration T1, so as to form a plurality of toner patches on the photoconductive drum 37 or the intermediate transfer belt 31. The density detection means comprises a sensor for detecting a density of each of the toner patches. The voltage-value determination means is adapted, based on respective detected densities of the toner patches, to determine the voltage value in the second direction P2 for pulling the toner back to the developing roller. In this case, based on respective densities of the toner patches formed on the photoconductive drum 37 or the intermediate transfer belt 31, the AC voltage can be readily adjusted to generate a force to pull a toner attached to the non-latent image region away therefrom without pulling a toner attached to the latent image region away therefrom. This makes it possible to desirably adjust a toner density in an easy manner while suppressing the occurrence of image unevenness due to the developing gap fluctuation.

Preferably, an a-Si photoconductive member is used as the photoconductive drum 37. This type of photoconductive member is characterized in that a latent image region (exposed region, image-forming region) has an extremely low potential of 20 V or less, and a non-latent image region (non-exposed region, non-image-forming region) has a high potential of about 350 V, although a saturation charge potential and a dielectric breakdown withstanding voltage will deteriorate as it has a smaller film thickness. In addition, a surface of the photoconductive member 3 during formation of an electrostatic latent image has an enhanced charge density to provide a potential for higher development performance. This characteristic becomes prominent particularly when the a-Si photoconductive member with a high dielectric constant of about 10 has a thickness of 25μ or less, preferably 20μ or less. For example, a photoconductive drum having a diameter of 30 mm is used as the photoconductive drum 37.

A positively-chargeable organic photoconductive member (OPC) may also be used as the photoconductive member 3. In this case, it is particularly important to set a film thickness of a photoconductive layer at 25 μm or more, and increase an amount of charge generation material to be added, in order to reduce a residual potential to 100 V or less. Particularly in an OPC with a single-layer structure, the charge generation material is added to the photoconductive layer. This can advantageously suppress a change in sensitivity even after wear of the photoconductive layer. In this case, the DC voltage of the developing bias voltage is preferably set at 400 V or less, more preferably 300 V or less, in view of preventing a strong electric field from being applied to toner.

A carrier to be contained in the two-component developing agent is not limited to a specific type, but may be any suitable connectional type. The carrier has two roles: one in collecting toner; and the other in supplying toner. Thus, preferably, a small-size carrier having a volume resistivity value of $10^6$ to $10^{13}$ Ωcm and an average particle size of 50 μm or less, is used. More specifically, a carrier having a volume resistivity value of $10^{10}$ Ωcm, a saturation magnetization of 65 emu/g and an average particle size of 45 μm may be used. The volume resistivity value set in the range of $10^6$ to $10^{13}$ Ωcm makes it possible to allow toner attached to the carrier electrostatically and firmly to be pulled away from the carrier at a nip between the developing roller 72 and the magnetic roller 73 by the magnetic bush, and supplied in an amount required for development. The small-size carrier having an average particle size of 50 μm or less is preferable in view of increasing a surface area to provide enhanced contact with toner.

A special device, such as scraper blade, to be used for toner remaining on the developing roller 72 after the development, may be provided on the surface of the developer roller 72, or may not be provided. For example, the magnetic brush on the magnetic roller 72 comes into contact with the toner layer on the developing roller 72 to facilitate collection and replacement of toner by taking advantage of a brushing effect based on a difference between respective circumferential velocities of the two rollers. The two-component developing agent serving as the magnetic brush is replaced according to agitation based on the paddle mixer 74 and the agitation mixer 75 to further facilitate the collection and replacement of toner.

In this case, a width of the magnetic brush corresponds to a width for collecting toner on the developing roller 72. Thus, the developing roller 72 may have a width less than that of the magnetic brush to reliably eliminate an uncollected region.

This makes it possible to reduce toner attaching to a developing roll sleeve beyond a coverable area of the magnetic roller, so as to prevent toner scattering at opposite ends of the developing roller.

Here, circumferential velocities of the photoconductive drum 37 and the developing roller 72 are set, for instance, 180 and 270 mm/sec, respectively and thus a ratio between said respective velocities becomes 1.5 for instance.

Preferably, a ratio between respective circumferential velocities of the magnetic roller 73 and the developing roller 72 (circumferential velocity of the magnetic roller 73/circumferential velocity of the developing roller 72) is set in the range of 1.0 to 2.0, for example, at 1.5.

In this case, the circumferential velocity of the magnetic roller 73 is set at 405 mm/sec. This makes it possible to facilitate the replacement of the two-component developing agent while collecting toner on the developing roller 72, and supply the two-component developing agent adjusted to an adequate toner density onto the development roller 72 so as to form an even toner layer.

While the above embodiment has been described by taking a tandem-type image forming apparatus as an example of the image forming apparatus of the present invention, the image forming apparatus of the present invention is not limited to the tandem type, but may be any other electrophotographic image forming apparatus. The developing unit of the present invention can suppress the occurrence of the image unevenness. Thus, the developing unit of the present invention can be applied to a small-sized tandem-type image forming apparatus to desirably solve the problem about image unevenness due to the developing gap fluctuation, which is likely to occur in the small-sized tandem-type image forming apparatus.

The above embodiment has also been described by taking a color printer as an example of a type of the image forming apparatus, the image forming apparatus of the present invention may be, for example, a copier, a facsimile machine or a complex machine. The above embodiment has also been described by taking a photoconductive drum, i.e., a drum-shaped photoconductive member, as an example of the photoconductive member, the photoconductive member in the present invention is not limited to the drum-shaped type, but the present invention may be applied, for example, to a belt-shaped or sheet-shaped photoconductive member.

[Experiments]

A result of experimental studies on conditions of the development bias voltage in a color printer 1 according to one embodiment of the present invention will be described below.

[Experiment 1]

Figure 5:
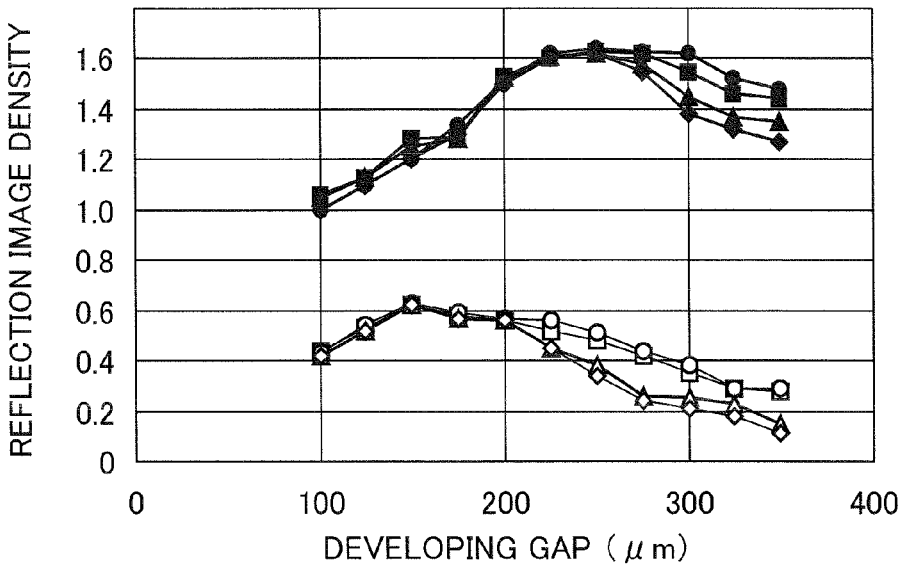
FIG. 5 is a graph showing a relationship between a developing gap and an image density in various DUTY ratios.

A result of experimental studies on influences of the DUTY ratio will be described. FIG. 5 is a graph showing a relationship between a developing gap and an image density in various DUTY ratios, wherein the vertical axis represents a reflection image density of each obtained image, and the horizontal axis represents a developing gap (μm). The reflection image density is a relative density measured using a reflection densitometer and determined on the basis of a sheet as a substrate. This graph shows a result of a test where images were formed using the following developing bias voltage:

| | |
|---|---|
| Frequency: | 5 kHz |
| The number of cycles: | 2 |
| V1 = | 1000 V |
| V2 = | −500 V |
| V3 = | 0 V |
| T1 = | T2 |

The term "continuous waveform" means a developing bias voltage which has only the first duration T1 to apply the AC voltage without the second duration T2 to stop applying the AC voltage.

As seen in FIG. 5, in a range where the developing gap is relatively wide, a level of lowering in the image density is reduced as the DUTY ratio is increased. FIG. 5 also shows that this effect of reducing the lowering level of the image density becomes prominent when the DUTY ratio is 50% or more.

[Experiment 2]

Figure 6:
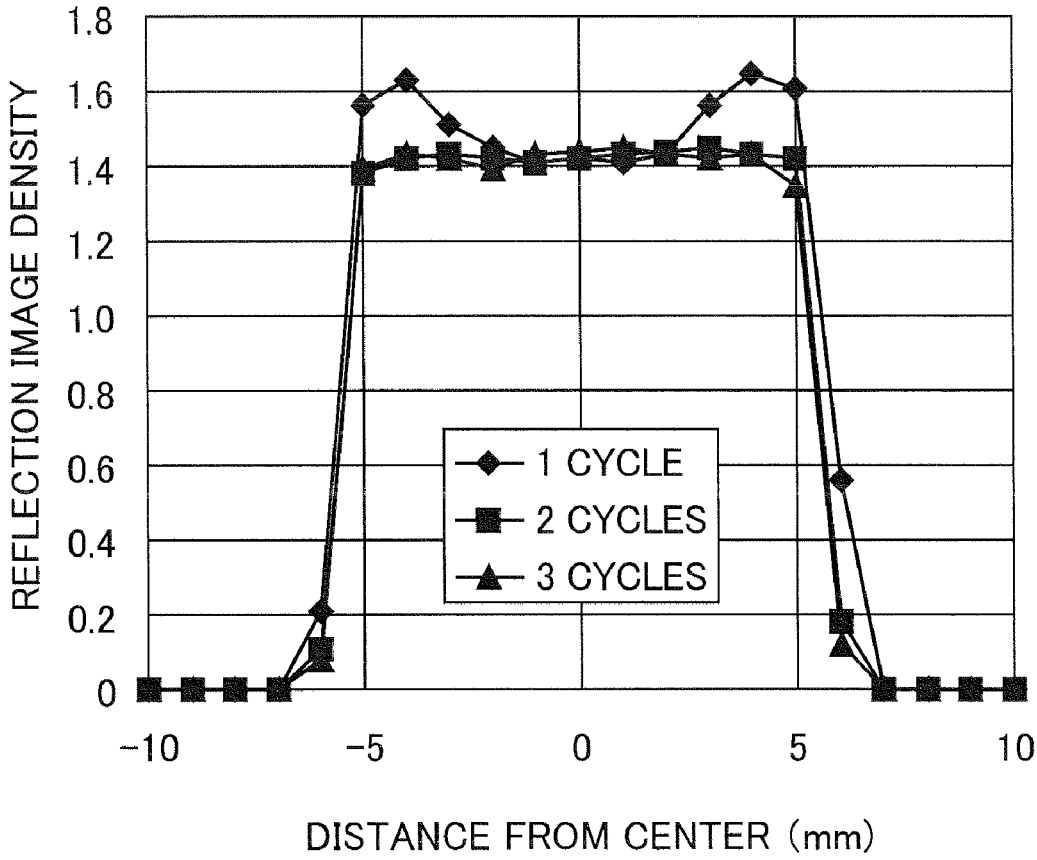
FIG. 6 is a graph showing a relationship between an image position and an image density in various numbers of cycles.

A result of experimental studies on the number of cycles will be described. FIG. 6 is a graph showing a relationship between an image position and an image density in various numbers of cycles, wherein the vertical axis represents a reflection image density of each obtained image, and the horizontal axis represents a distance from a center of the image (mm). Except that the number of cycles is varied, and the DUTY ratio is fixed at 50%, a development bias voltage in the Experiment 2 is the same as that in the Experiment 1. An image formed in the Experiment 2 was a solid image having a width of 12 mm.

As seen from FIG. 6, when the number of cycles is set at one, an edge region has a higher image density than that in the remaining (i.e., inward) region. The reason would be that toner is likely to attach to the edge region in an initial stage. FIG. 6 shows that the number of cycles can be set at two or more to eliminate a difference between respective image densities in the edge region and the inward region. The reason would be that toner attached to the edge region is moved inwardly, i.e., promote the rearrangement of toner, by increasing the number of cycles up to at two or more.

[Experiment 3]

A result of experimental studies on an influence of a direction of an AC voltage just before transition from T1 to T2 will be described. A fog level in a non-image region and an image density were measured when the AC voltage just before transition from T1 to T2 was set at respective voltages in the first direction P1 for causing toner to develop an electrostatic latent image and in the second direction P2 for pulling toner back to the developing roller 72. The result is shown in Table 1.

TABLE 1

| | P1 | | P2 | |
|---|---|---|---|---|
| AC Voltage Just Before Transition from T1 to T2 | FOG LEVEL | REFLECTION IMAGE DENSITY | FOG LEVEL | REFLECTION IMAGE DENSITY |
| 1 CYCLE | X | 1.65 | Δ | 1.46 |
| 2 CYCLES | X | 1.67 | ○ | 1.47 |
| 3 CYCLES | X | 1.64 | ○ | 1.45 |
| 4 CYCLES | X | 1.65 | ○ | 1.46 |
| 5 CYCLES | X | 1.66 | ○ | 1.45 |

As seen in Table 1, in view of preventing the occurrence of fogging in the non-image region, the AC voltage just before transition from T1 to T2 has to be set in the second direction P2 for pulling toner back to the developing roller 72. It is also proven that the number of cycles is desirably set at two or more in view of suppressing the occurrence of fogging in the non-image region.

[Experiment 4]

Figure 7:
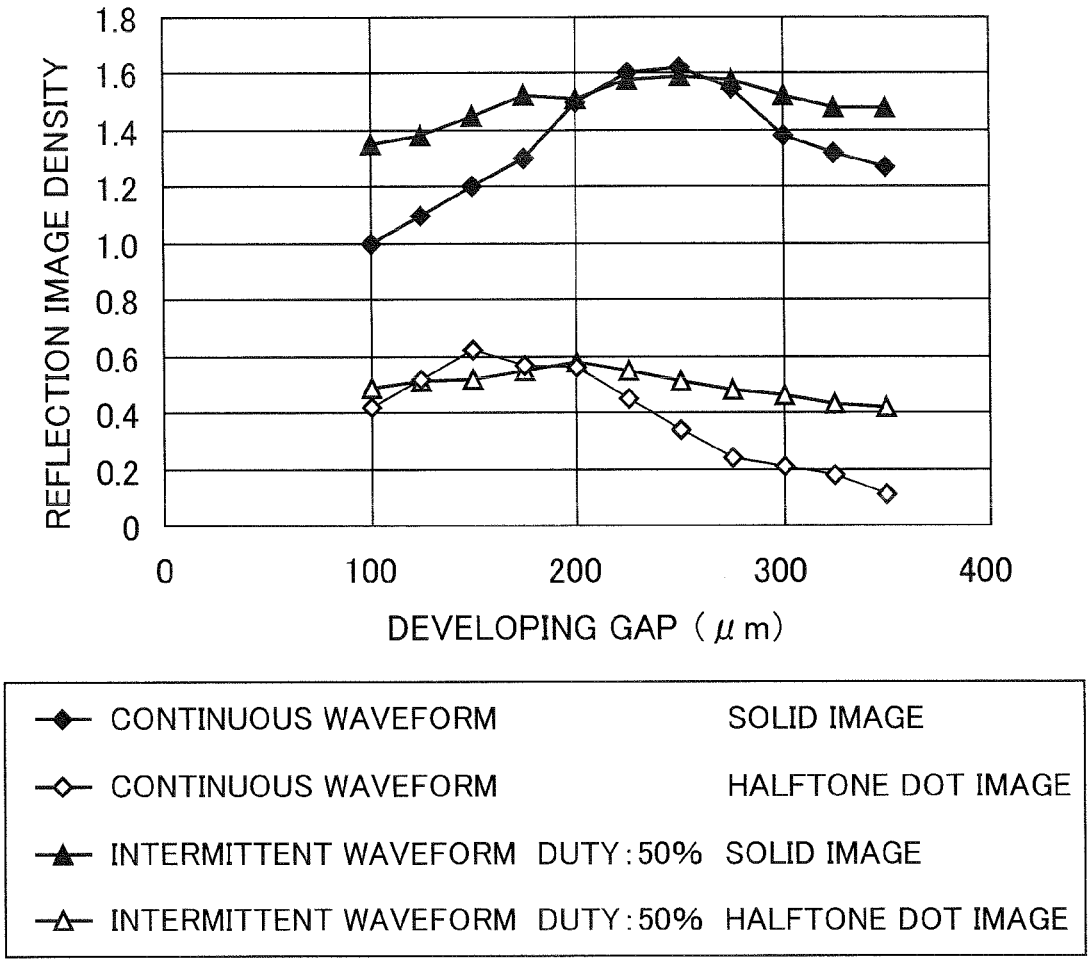
FIG. 7 is a graph for comparing one case of applying a desirable developing bias voltage with another case of applying a voltage having a continuous waveform.

A comparison between two cases where a desirable developing bias voltage determined based on the results from the Experiments 1 to 3 (i.e., the aforementioned developing bias voltage described as a specific preferred example) was applied and where a voltage with a continuous waveform was applied will be described. FIG. 7 is a graph for comparing one case of applying a desirable developing bias voltage with another case of applying a voltage having a continuous waveform, wherein the vertical axis represents a reflection image density of each obtained image, and the horizontal axis represents a developing gap (μm).

As seen in FIG. 7, when a developing bias voltage (desirable developing bias voltage) where a DUTY ratio is 50% in the direction for causing toner to develop an electrostatic latent image; the number of cycles of the AC voltage in T1 is two or more; the AC voltage just before transition from T1 to T2 is a voltage in the direction for pulling toner back to the developing roller 72 is applied, a fluctuation in image density due to the developing gap fluctuation is reduced. This proves that the desirable developing bias voltage can be applied to the developing roller 72 to suppress the occurrence of image unevenness due to the developing gap fluctuation.

[Experiment 5]

Figure 8:
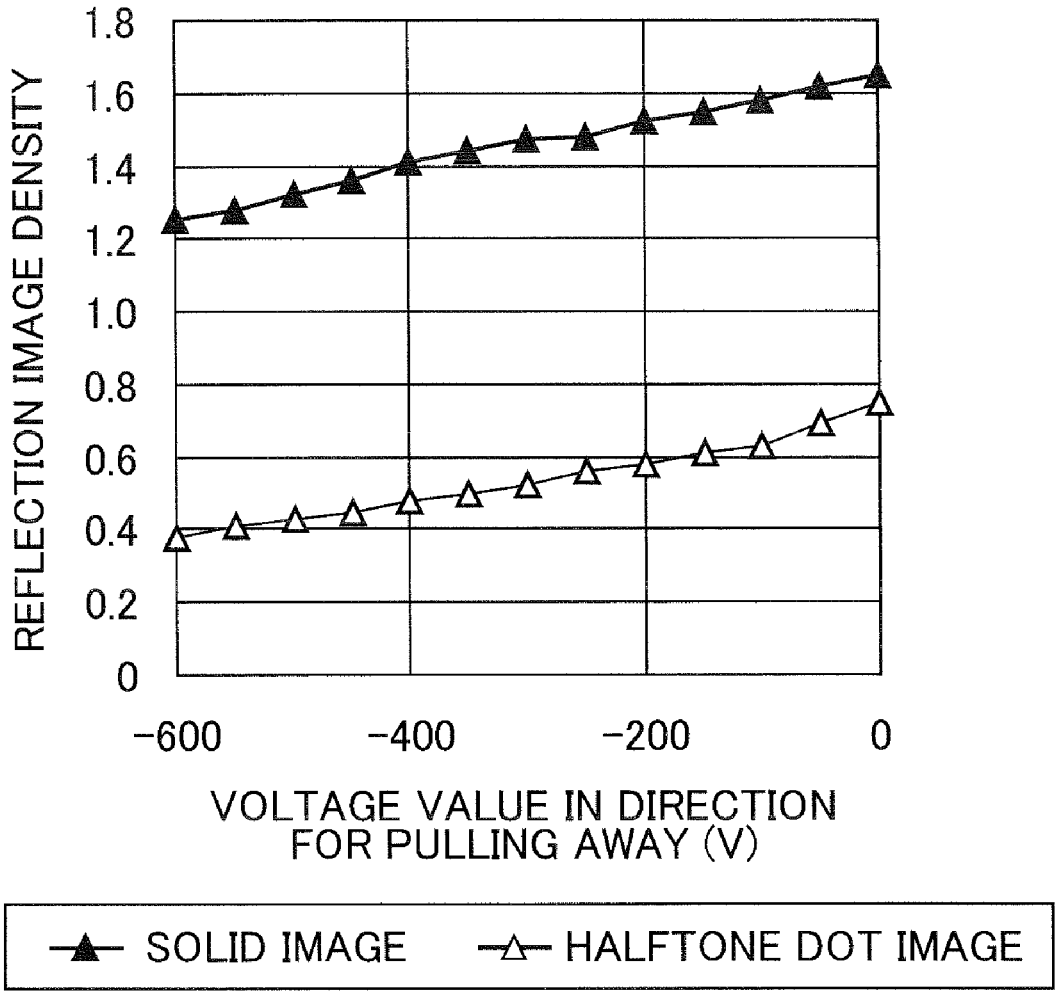
FIG. 8 is a graph showing a relationship between an image density and a voltage value V2 in a direction for pulling toner back to a developing roller 72.

A result of experimental studies on an influence of a voltage value of the AC voltage in the direction for pulling toner back to the developing roller 72 will be described. FIG. 8 is a graph showing a relationship between an image density and a voltage value V2 in a direction for pulling toner back to the developing roller 72, wherein the vertical axis represents a reflection image density of each obtained image, and the horizontal axis represents V2 (V). This graph shows a result of a test where an image was formed using the following developing bias voltage:

| | |
|---|---|
| Frequency: | 4 kHz |
| The number of cycles: | 2 |
| DUTY ratio: | 50% |
| V1 = | 1000 V |
| V3 = | 0 V |
| T1 = | T2 |

As seen in FIG. 8, a density of an image to be obtained can be adjusted by changing V2. This proves that V2 can be determined based on a detection result of image density from a density sensor to readily obtain a desired image density.

[Experiment 6]

Figure 9:
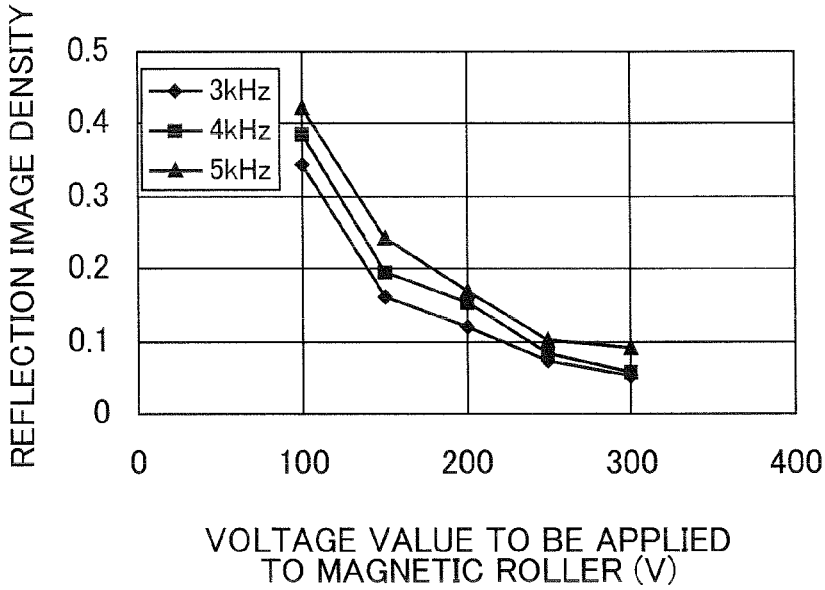
FIG. 9 is a graph showing a relationship between an image density and a value of voltage to be applied to a magnetic roller in various frequencies of the voltage to be applied to the magnetic roller.
Figure 10:
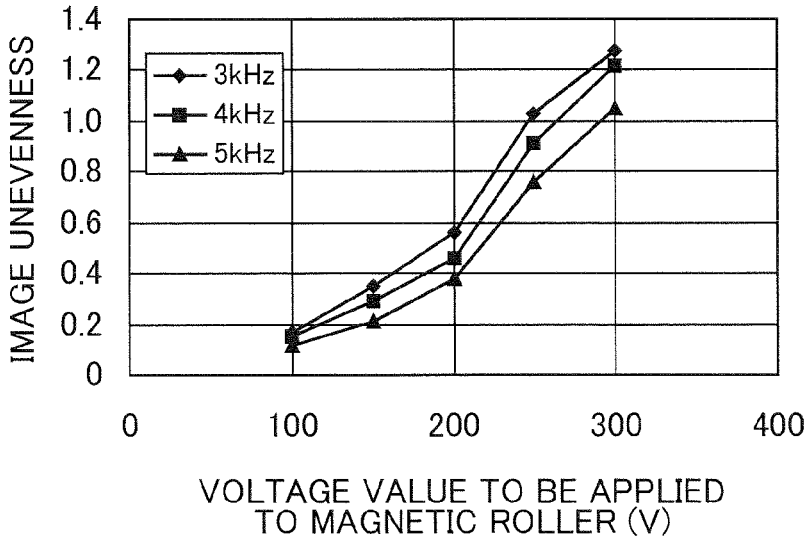
FIG. 10 is a graph showing a relationship between a level of image unevenness and a value of the voltage to be applied to the magnetic roller in various frequencies of the voltage to be applied to the magnetic roller.
Figure 11:
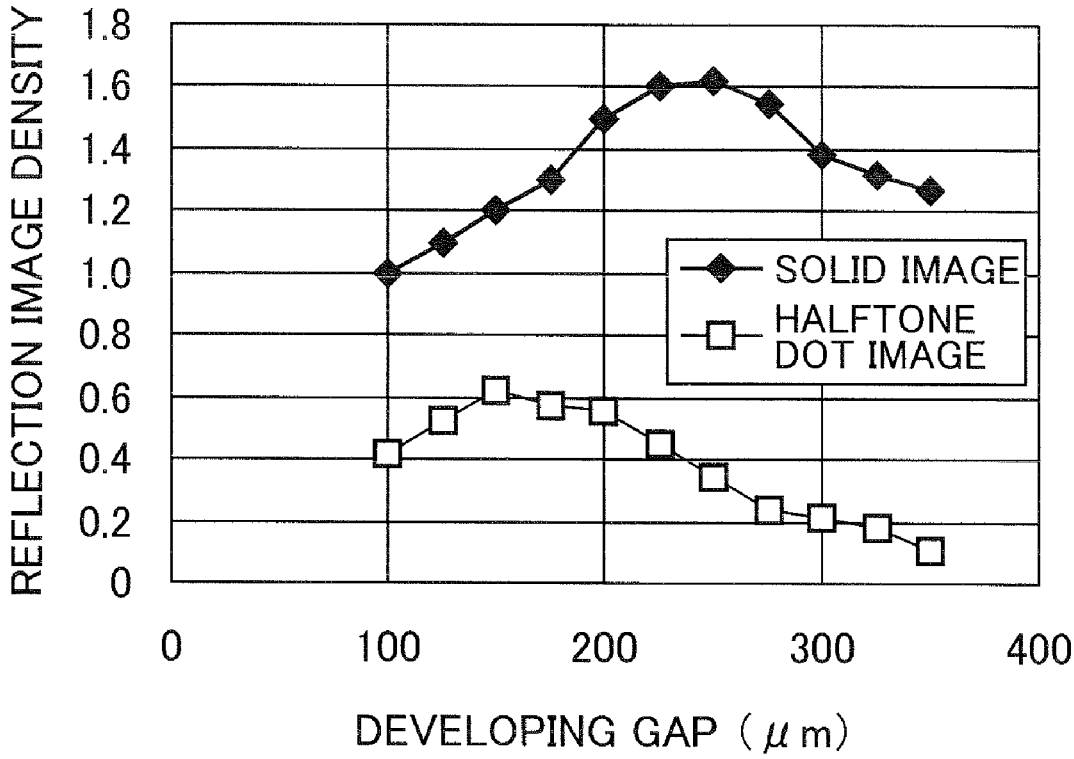
FIG. 11 is a graph showing an influence of a developing gap on an image density of a solid image and a halftone dot image.

A result of experimental studies on an influence of a voltage to be applied to the magnetic roller will be described. FIG. 9 is a graph showing a relationship between an image density and a value of voltage to be applied to the magnetic roller in various frequencies of the voltage to be applied to the magnetic roller, wherein the vertical axis represents a reflection image density of each obtained image, and the horizontal axis represents a voltage value (V) to be applied to the magnetic roller. FIG. 10 is a graph showing a relationship between a level of image unevenness and a value of the voltage to be applied to the magnetic roller in various frequencies of the voltage to be applied to the magnetic roller, wherein the vertical axis represents a level of unevenness in each obtained image, and the horizontal axis represents a voltage value (V) to be applied to the magnetic roller. This graph shows a result of a test where the desired developing bias voltage was applied to form a halftone dot image (25%).

As seen in FIG. 9, the image density is lowered as the voltage value to be applied to the magnetic roller is increased, and this tendency is not so dependent on the frequency. As seen in FIG. 10, the level of image unevenness becomes higher as the voltage value to be applied to the magnetic roller is increased, and this tendency is not so dependent on the frequency. This proves that it is difficult to achieve both a high image density and a reduction of image unevenness based on control of the voltage value to be applied to the magnetic roller, and the developing bias voltage to be applied to the developing roller can be effectively controlled to reduce the level of image unevenness, as in the present invention. It is also proven that the voltage value to be applied to the magnetic roller is preferable set at 200 V in view of balance between image density and image unevenness.

As is evidenced from the above experimental results, the occurrence of image unevenness due to the developing gap fluctuation can be suppressed by applying the developing bias voltage set such that: it includes a first duration to apply an AC voltage having a rectangular waveform, and a second duration to stop applying the AC voltage; the AC voltage has a duty ratio of 50% or more, in a direction for causing the toner to develop the electrostatic latent image; the number of cycles of the AC voltage in the first duration is two or more; and the AC voltage has a voltage in the second direction for pulling the toner back to the developing roller 72, just before transition from the first duration to the second duration.

In summary, the present invention provides a developing unit which comprises: a developing roller disposed in opposed relation to an image support member which has an electrostatic latent image formed thereon, and adapted to transport toner while supporting the toner on a surface thereof, and voltage-applying means adapted to apply a developing bias voltage to the developing roller, in such a manner as to cause the toner transported by the developing roller to fly onto a surface of the image support member so as to allow an electrostatic latent image pre-formed on the surface of the image support member to come out as a toner image. In the developing unit, the developing bias voltage to be applied from the voltage-applying means to the developing roller is set to satisfy the following conditions. The developing bias voltage including a first duration to apply an AC voltage having a rectangular waveform, and a second duration to stop applying the AC voltage, and the AC voltage has a duty ratio of 50% or more, in a direction for causing the toner to develop the electrostatic latent image. Further, the number of cycles of the AC voltage in the first duration is two or more, and the AC voltage has a voltage in a direction for pulling the toner back to the developing roller, just before transition from the first duration to the second duration.

In the above developing unit of the present invention, the duty ratio of the AC voltage having a rectangular waveform is set at 50% or more, in the direction for causing the toner to develop the electrostatic latent image. That is, in the first duration to apply the AC voltage, a time-period to apply a voltage in the direction for developing an electrostatic latent image pre-formed on the surface of the image support member is equal to or greater than a time-period to apply a voltage in the direction for pulling the toner back to the developing roller. Thus, even when a developing gap becomes wider, a large amount of toner can reach the image support member so as to suppress image unevenness, particularly image unevenness due to lowering in density of a halftone dot image, which is likely to occur when the developing gap becomes wider.

Further the number of cycles of the AC voltage in the first duration is set at two or more. That is, the voltage in the direction for causing toner to develop an electrostatic latent image, and the voltage in the direction for pulling toner back to the developing roller, are alternately applied two times or more each. Thus, a force to allow a toner attached to a latent image region to be more firmly attached thereto, and a force in the direction for pulling the toner away from the latent image region, are alternately applied to the toner to promote rearrangement of the toner so as to evenly attach the toner to the latent image region. In addition, the two types of alternate forces allow a toner attached to a non-latent image region to be attached to the latent image region. This makes it possible to form an image more accurately conforming to a shape of the electrostatic latent image.

Furthermore, the AC voltage has a voltage in the second direction for pulling toner back to the developing roller, just before transition from the first duration to the second duration. That is, the force to pull toner back to the developing roller is lastly applied, and then the developing bias voltage is changed to the second duration to stop applying the AC voltage. Thus, a weak force for preventing the toner attached to the latent image region from being pulled away from the latent image region can be applied in the direction for causing toner to move from the image support member toward the developing roller for a relatively long time, so that a toner attached to the non-latent image region can be pulled away therefrom without pulling a toner attached to the latent region away therefrom so as to suppress a fog phenomenon. This makes it possible to suppress image unevenness, particularly image unevenness due to pulling-away in the solid image, which is likely to occur when the developing gap becomes narrower.

As above, the developing unit of the present invention can suppress the occurrence of image unevenness due to a fluctuation in the developing gap.

The present invention also provides a developing unit which comprises: a developing roller disposed in opposed relation to an image support member which has an electrostatic latent image formed thereon, and adapted to transport toner while supporting the toner on a surface thereof, a magnetic roller adapted to support and transport a two-component developing agent containing a toner and a carrier; voltage-applying means adapted to apply a developing bias voltage to the magnetic roller and the developing roller, in such a manner as to cause the toner in the two-component developing agent transported by the magnetic roller and brought into contact with the developing roller to move onto the surface of the developing roller, and then cause the toner supportedly transported by the developing roller to fly onto a surface of the image support member so as to allow an electrostatic latent image pre-formed on the surface of the image support member to come out as a toner image. In this developing unit, the developing bias voltage to be applied from the voltage-applying means to the developing roller is set to satisfy the following conditions. The developing bias voltage including a first duration to apply an superimposed voltage formed by superimposing an AC voltage having a rectangular waveform on a DC voltage, and a second duration to apply only the DC voltage, and the AC voltage has a duty ratio of 50% or more, in a direction for causing the toner to develop the electrostatic latent image. Further, the number of cycles of the AC voltage in the first duration is two or more, and the AC voltage has a voltage in a direction for pulling the toner back to the developing roller, just before transition from the first duration to the second duration.

In this developing unit of the present invention, the duty ratio of the AC voltage having a rectangular waveform is set at 50% or more, in the direction for causing the toner to develop the electrostatic latent image. That is, in the first duration to apply the AC voltage, a time-period to apply a voltage in the direction for developing an electrostatic latent image pre-formed on the surface of the image support member is equal to or greater than a time-period to apply a voltage in the direction for pulling the toner back to the developing roller. Thus, even when a developing gap becomes wider, a large amount of toner can reach the image support member so as to suppress image unevenness, particularly image unevenness due to lowering in density of a halftone dot image, which is likely to occur when the developing gap becomes wider.

Further, the number of cycles of the AC voltage in the first duration is set at two or more. That is, the voltage in the direction for causing toner to develop an electrostatic latent image, and the voltage in the direction for pulling toner back to the developing roller, are alternately applied two times or more each. Thus, a force to allow a toner attached to a latent image region to be more firmly attached thereto, and a force in the direction for pulling the toner away from the latent image region, are alternately applied to the toner to promote rearrangement of the toner so as to evenly attach the toner to the latent image region. In addition, the two types of alternate forces allow a toner attached to a non-latent image region to be attached to the latent image region. This makes it possible to form an image more accurately conforming to a shape of the electrostatic latent image.

Furthermore, the AC voltage has a voltage in the second direction for pulling toner back to the developing roller, just before transition from the first duration to the second duration. That is, the force to pull toner back to the developing roller is lastly applied, and then the developing bias voltage is changed to the second duration to stop applying the AC voltage. Thus, a weak force for preventing the toner attached to the latent image region from being pulled away from the latent image region can be applied in the direction for causing toner to move from the image support member toward the developing roller for a relatively long time, so that a toner attached to the non-latent image region can be pulled away therefrom without pulling a toner attached to the latent region away therefrom so as to suppress a fog phenomenon. This makes it possible to suppress image unevenness, particularly image unevenness due to pulling-away in the solid image, which is likely to occur when the developing gap becomes narrower.

As above, this developing unit of the present invention can suppress the occurrence of image unevenness due to a fluctuation in the developing gap. In addition, the developing unit of the present invention is a type, so-called "hybrid type", of using a two-component developing agent containing a toner and a carrier, and developing an electrostatic latent image based on the toner of the two-component developing agent transported from a magnetic roller. The present invention can also be applied to this type of developing unit, so as to suppress the occurrence of image unevenness, particularly, due to a fluctuation in the developing gap.

Preferably, in the above development unit, the voltage-applying means is operable to fix a voltage value of the AC voltage which is in the direction for causing the toner to develop the electrostatic latent image, and change a voltage value of the AC voltage which is in a direction for pulling the toner back to the developing roller. According to this feature, the AC voltage can be adjusted to generate a force to pull a toner attached to the non-latent image region away therefrom without pulling a toner attached to the latent image region away therefrom. This makes it possible to desirably adjust a toner density in an easy manner while suppressing the occurrence of image unevenness due to the developing gap fluctuation.

The present invention further provides an image forming apparatus which comprises the above developing unit, wherein the developing unit is used for allowing an electrostatic latent image pre-formed on the surface of the image support member to come out as a toner image so as to form an image. The image forming apparatus can enjoy the advantages of the developing unit of the present invention so as to form a high-quality image on a recording medium while suppressing the occurrence of image unevenness due to the developing gap fluctuation.

Preferably, the image forming apparatus of the present invention further comprises: an intermediate transfer member adapted to allow the toner image to be transferred from the image support member thereto, and allow the transferred toner image to be transferred to a recording medium therefrom; toner patch forming means adapted to fix a voltage value of the AC voltage which is in a direction for causing the toner to fly toward the image support member in the first duration, and change a voltage value of the AC voltage which is in a direction for pulling the toner back to the developing roller in the first duration, so as to form a plurality of toner patches on the image support member or the intermediate transfer member; density detection means adapted to detect a density of each of the toner patches; and voltage-value determination means adapted to determine the voltage value in the direction for pulling the toner back to the developing roller.

According to this feature, based on respective densities of the toner patches formed on the image support member or the intermediate transfer member, the AC voltage can be readily adjusted to generate a force to pull a toner attached to the non-latent image region away therefrom without pulling a toner attached to the latent image region away therefrom. This makes it possible to desirably adjust a toner density in an easy manner while suppressing the occurrence of image unevenness due to the developing gap fluctuation.

This application is based on Japanese Patent Application Serial No. 2007-065552, filed in Japan Patent Office on Mar. 14, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a developing roller disposed in opposed relation to an image support member which has an electrostatic latent image formed thereon, the developing roller transporting toner while supporting the toner on a surface thereof;

voltage-applying means for applying a developing bias voltage to said developing roller, in such a manner as to cause the toner transported by said developing roller to fly onto a surface of said image support member so as to allow an electrostatic latent image pre-formed on the surface of said image support member to come out as a toner image, wherein said developing bias voltage to be applied from said voltage-applying means to said developing roller is set to satisfy the following conditions (i) to (iv):

(i) said developing bias voltage including a first duration to apply an AC voltage having a rectangular waveform, and a second duration to stop applying said AC voltage;

(ii) said AC voltage has a duty ratio of 50% or more, in a direction for causing the toner to develop the electrostatic latent image;

(iii) the number of cycles of said AC voltage in said first duration is two or more; and (iv) said AC voltage has a voltage in a direction for pulling the toner back to said developing roller, just before transition from said first duration to said second duration;

an intermediate transfer member disposed to allow said toner image to be transferred from said image support member to said intermediate transfer member, and disposed to allow said transferred toner image to be transferred from said intermediate transfer member to a recording medium;

toner patch forming means for fixing a voltage value of the AC voltage which is in a direction for causing the toner to fly toward said image support member in a first duration, and change a value of the AC voltage which is in a direction for pulling the toner back to said developing roller in said first duration, so as to form a plurality of toner patches on said image support member or said intermediate transfer member;

density detection means for detecting a density of each of said toner patches; and voltage-value determination means for determining the voltage value in said direction for pulling the toner back to said developing roller.

2. The image forming apparatus according to claim 1, wherein said voltage-applying means is operable to fix a voltage value of the AC voltage which is in said direction for causing the toner to develop the electrostatic latent image, and change a voltage value of the AC voltage which is in a direction for pulling the toner back to said developing roller according to the toner density.

3. An image forming apparatus comprising:

a developing roller disposed in opposed relation to an image support member which has an electrostatic latent image formed thereon, and to the developing roller transporting toner while supporting the toner on a surface thereof;

a magnetic roller supporting and transporting a two-component developing agent containing a toner and a carrier; and voltage-applying means for applying a developing bias voltage to said magnetic roller and said developing roller, in such a manner as to cause said toner in said two-component developing agent transported by said magnetic roller and brought into contact with said developing roller to move onto the surface of said developing roller, and then cause the toner supported and transported by said developing roller to fly onto a surface of said image support member so as to allow an electrostatic latent image pre-formed on the surface of said image support member to come out as a toner image, wherein said developing bias voltage to be applied from said voltage-applying means to said developing roller is set to satisfy the following conditions (i) to (iv):

(i) said developing bias voltage including a first duration to apply an superimposed voltage formed by superimposing an AC voltage having a rectangular waveform on a DC voltage, and a second duration to apply only said DC voltage;

(ii) said AC voltage has a duty ratio of 50% or more, in a direction for causing the toner to develop the electrostatic latent image;

(iii) the number of cycles of said AC voltage in said first duration is two or more; and (iv) said AC voltage has a voltage in a direction for pulling the toner back to said developing roller, just before transition from said first duration to said second duration;

an intermediate transfer member disposed to allow said toner image to be transferred from said image support member to the intermediate transfer member, and to allow said transferred toner image to be transferred from said intermediate transfer member to a recording medium;

toner patch forming means for fixing a voltage value of the AC voltage which is in a direction for causing the toner to fly toward said image support member in said first duration, and change a voltage value of the AC voltage which is in a direction for pulling the toner back to said developing roller in said first duration, so as to form a plurality of toner patches on said image support member or said intermediate transfer member;

density detection means for detecting a density of each of said toner patches; and voltage-value determination means for determining the voltage value in said direction for pulling the toner back to said developing roller.

4. The image forming apparatus according to claim 3, wherein said voltage-applying means is operable to fix a voltage value of the AC voltage in said direction for causing the toner to develop the electrostatic latent image, and change a voltage value of the AC voltage in a direction for pulling the toner back to said developing roller.

* * * * *